US005100261A

United States Patent [19]

Plemon

[11] Patent Number: 5,100,261

[45] Date of Patent: Mar. 31, 1992

[54] HOT AND COLD WATER SUPPLY SYSTEM TO BODY PROTECTOR

[75] Inventor: Donald L. Plemon, 4130 Branam Rd., Merced, Calif. 95340

[73] Assignees: Donald L. Plemon; Kevin M. Collins, both of Merced, Calif. ; a part interest

[21] Appl. No.: 597,014

[22] Filed: Oct. 15, 1990

[51] Int. Cl.[5] ..... B63C 11/28

[52] U.S. Cl. ..... 405/186; 126/204

[58] Field of Search ..... 405/185, 186, 187; 126/204, 210

[56] References Cited

U.S. PATENT DOCUMENTS

| | | | |
|---|---|---|---|
| 3,815,573 | 6/1974 | Marcus | 126/204 |
| 4,208,152 | 6/1980 | Colston | 405/186 |
| 4,274,759 | 6/1981 | Long et al. | 405/186 |
| 4,390,305 | 6/1983 | Sloan | 405/186 |

*Primary Examiner*—David H. Corbin

*Attorney, Agent, or Firm*—William W. Haefliger

[57] ABSTRACT

A system for supplying controlled temperature warm water to the space between a human body and a protector extending over the body comprising a source of pressurized water; a heat exchanger connected to the source to receive and heat the source water and discharge water at temperature $T_1$; a mixing valve connected to the heat exchanger to receive the water discharge from the heat exchanger, the mixing valve having a cold water inlet and being operable to mix cold water with the water at temperature $T_1$ received from the heat exchanger, thereby to provide and discharge a mixed water stream at controlled temperature $T_2$, where $T_2$ is less than $T_1$; a plenum chamber connected with the mixing valve to receive discharged water at temperature $T_2$ for mixing with warm water in the plenum chamber; and a duct extending from an outlet at the plenum chamber to deliver warm water to the space.

9 Claims, 2 Drawing Sheets

HOT AND COLD WATER SUPPLY SYSTEM TO BODY PROTECTOR

BACKGROUND OF THE INVENTION

This invention relates generally to apparatus usable by a diver to provide warmth, and more particularly to a system for supplying controlled temperature warm water to the space between the diver's body and a protector extending over the body.

Divers who remain partly or fully submerged in cold water for extended periods of time suffer from the chilling effects of the cold water. They have used protective garments, such as elastomeric fabric "wet" suits that establish a protective film of water between the suit and the skin, tending to promote warmth by body heating of the film; however, such protection is frequently insufficient, especially over longer periods of time. There is need for means to positively supply controlled temperature warm water from an external source to the space inside the suit and adjacent the diver's body. There is also need to provide protection against sudden inadvertent changes in the temperature of the supplied water.

SUMMARY OF THE INVENTION

It is a major object of the invention to provide a warm water supply system efficiently meeting the above needs. Basically, the invention is embodied in a system that includes:

(a) source of pressurized water, (b) a heat exchanger connected to the source to receive and heat the source water and discharge water at temperature $T_1$, (c) a mixing valve connected to the heat exchanger to receive the water discharge from the heat exchanger, the mixing valve having a cold water inlet and being operable to mix cold water with the water at temperature $T_1$ received from the heat exchanger, thereby to provide and discharge a mixed water stream at controlled temperature $T_2$, where $T_2$ is less than $T_1$, (d) a plenum chamber connected with the mixing valve to receive discharged water at temperature $T_2$ for mixing with warm water in the plenum chamber, and (e) a duct extending from an outlet at the plenum chamber to deliver warm water to the space between the diver's body protector and his body.

As will be seen, the warm water in the plenum chamber acts as a buffer in the event of a sharp, inadvertent change in the temperature of the water delivered from the mixing valve.

Another object of the invention is to provide a cold water pump discharging to the mixing valve, and driven by an internal combustion engine, the hot exhaust gases from the engine being used as a source of heat for the heat exchanger.

Yet another object is to provide the protector in the form of an elastomer wet suit to which the duct from the plenum chamber is efficiently connected, and via a control valve operable by the diver.

These and other objects and advantages of the invention, as well as the details of an illustrative embodiment, will be more fully understood from the following specification and drawings, in which:

DRAWING DESCRIPTION

DETAILED DESCRIPTION

Figure 1:
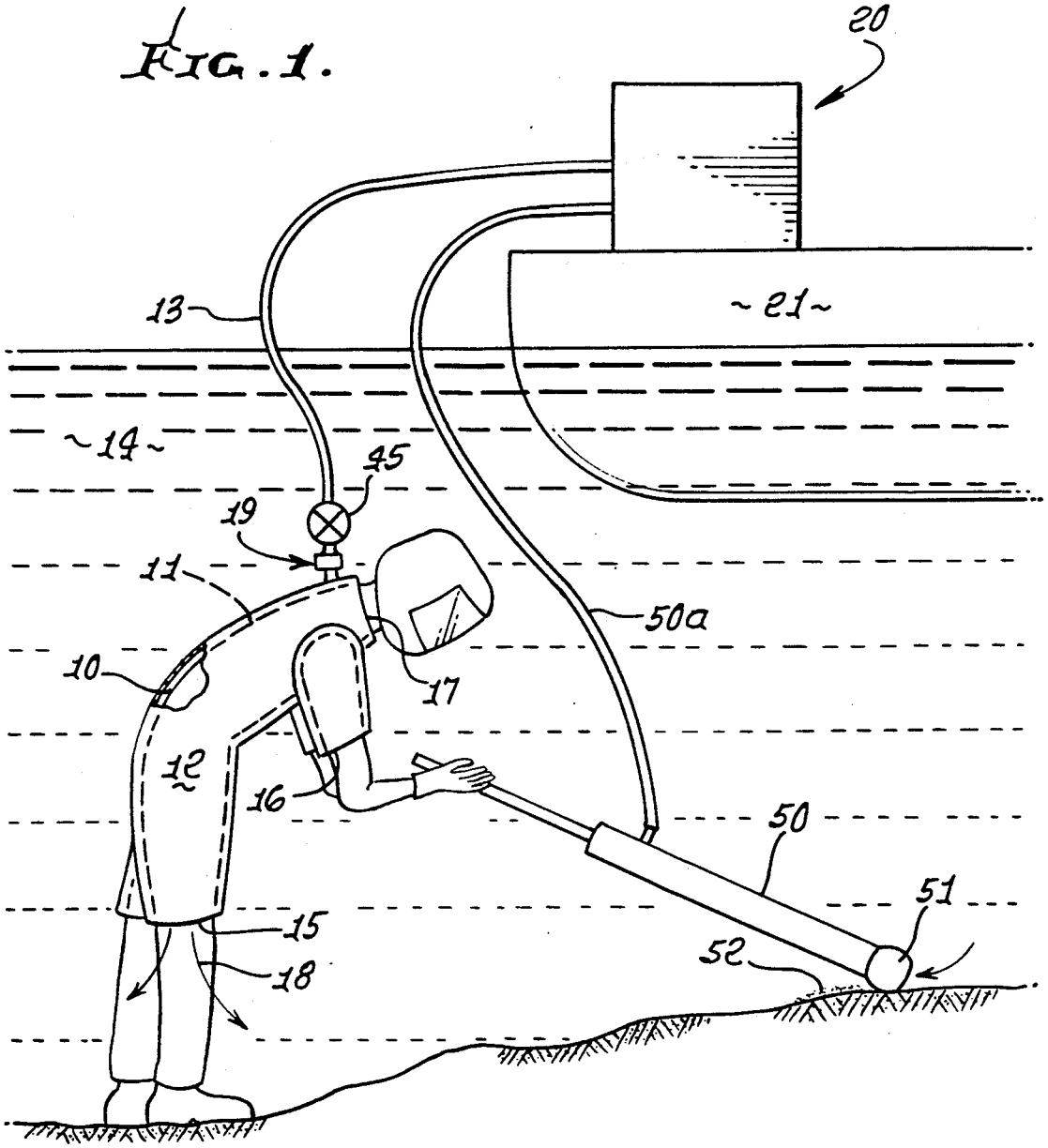
FIG. 1 is an elevation showing a system for supplying controlled temperature warm water to the space between a human body and a protector extending over the body.
Figure 2:
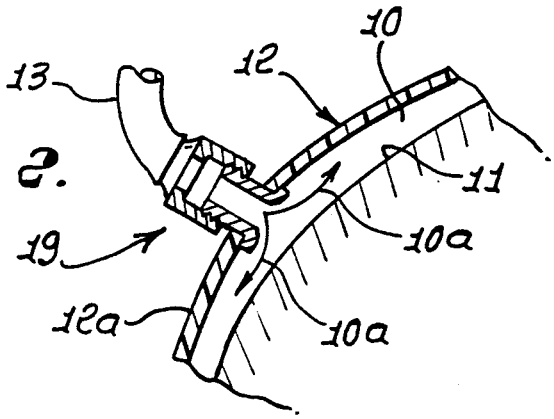
FIG. 2 shows a hose connection to the protector.
Figure 3:
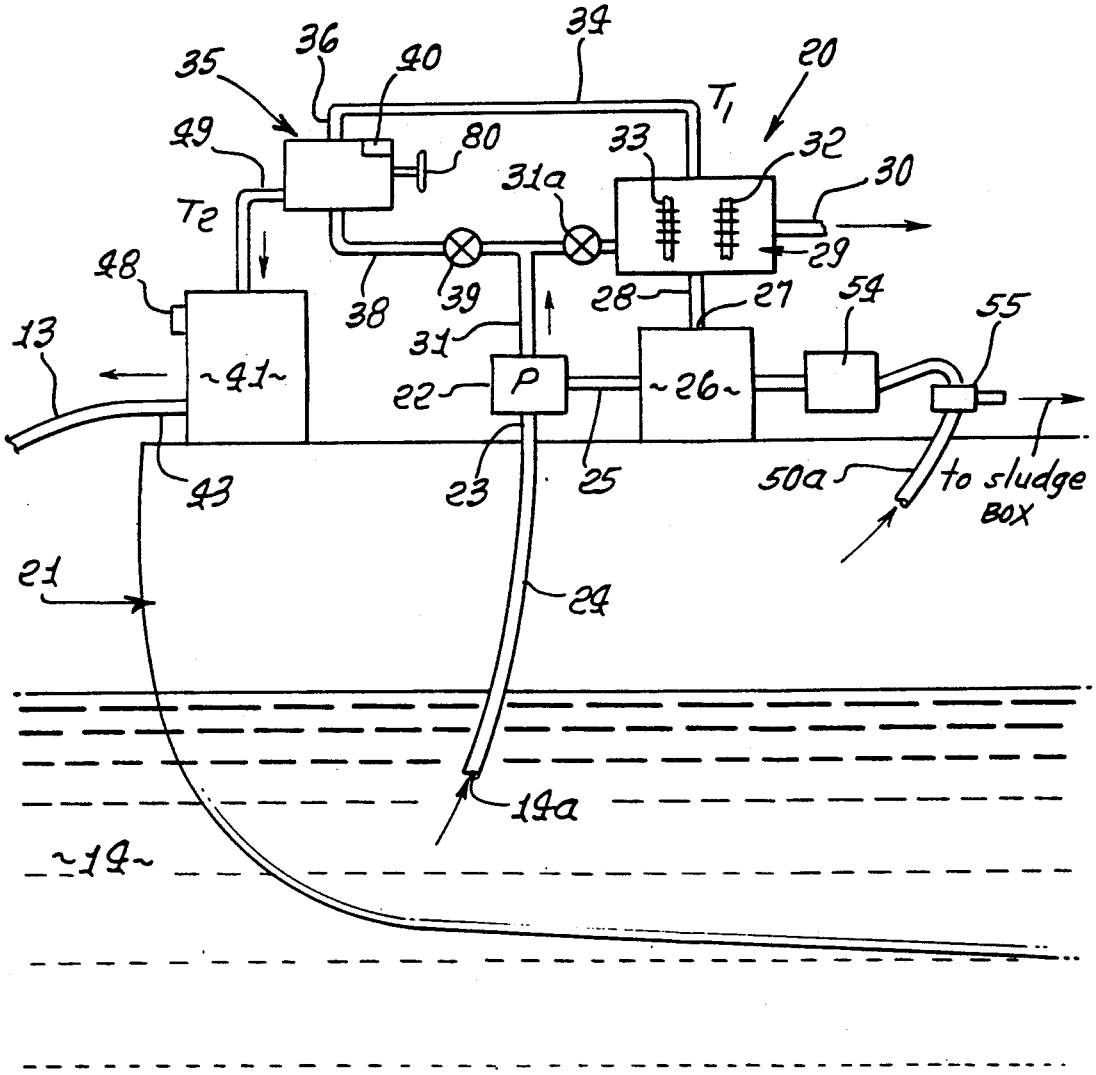
FIG. 3 shows system details.

The system seen in FIGS. 1–3 is constructed to supply controlled temperature warm water to the space 10 between a human body 11 and a protector, such as a wet suit 12, extending over the diver's body 11. Such wet suits are well known, examples being disclosed in U.S. Pat. Nos. 4,464,795 and 4,862,517. The warm water may be delivered to space 10, as via a duct or hose 13 suitably connected to the wet suit, as seen at 19 in FIG. 2. Other type connections are also possible. Note the warm water flowing at 10*a* into space 10 under pressure and tending to swell the suit fabric 12*a* away from the body. Such warm water keeps the diver warm in cold sea water or other (river, stream, pond) water body environments 14, and it discharges from the space 10 adjacent the suit leg, arm, and neck terminals 15–17 of the suit. See arrows 18.

The system seen at 20, as on a dredge or dock or boat 21, includes a series of components easily assembled or connected together. These include a source of pressurized water, such as a pump 22, having a cold water inlet 23 to which water may be supplied, as via a hose 24, extending into water body 14. Note hose inlet 14*a*. The pump is driven at 25 by an internal combustion engine 26 having a hot exhaust outlet at 27. Hot gaseous products of combustion flow via duct 28 to and through a heat exchanger 29, passing to the atmosphere at 30.

The heat exchanger 29 is connected to the cold water source, i.e, pump 22, as via a duct 31, to receive a stream of cold or cool water under pressure. A control valve 31*a* may be connected in series with line 31, as shown. In flowing through the heat exchanger, the cold water is heated by heat transfer from the hot exhaust gases to the entering water. See for example water flow ducts 32 which are finned at 33 to receive heat from the hot gases and to transfer heat to the water. Heated water discharges from the heat exchanger to flow via duct 34 to a mixing valve 35, the hot water for example being at temperature $T_1$.

The mixing valve 35 has an inlet at 36 to receive hot water from the heat exchanger, and it has a second inlet at 37 to receive cold water from the pump 22 via duct 38 and control valve 39. It is operable to mix cold water with the hot water at temperature $T_1$, so as to provide a discharge at 49, i.e., a mixed water stream at controlled temperature $T_2$, where $T_2$ is normally less than $T_1$. Valve 35 may incorporate a thermostat 40 which controls the mixing valve to cause it to operate as described. Such thermostat controlled mixing valves are known. A manual control such as knob 80 enables control of the thermostat to adjust $T_2$.

A plenum chamber, i.e., buffer tank 41, is connected with the discharge side of the mixing valve to receive discharged water at temperature $T_2$ for mixing with warm water in the plenum chamber 41 at temperature $T_2$ or close to that temperature. $T_2$ is between about 100° F. and 110° F. The discharge outlet, at 43, of the chamber 41 is in turn connected via hose or line 13 with the wet suit 12, as described. If for some reason water at a higher than desired temperature $T_3$ enters the buffer tank 41, the water already in the latter prevents water at temperature $T_3$ from entering line 13 for flow to the space 10 adjacent the diver's body. Buffer water at temperature $T_2$ in tank 41 mixes with temperature $T_3$ water, and then flows to space 10 whereby the diver detects a slowly rising temperature, and he has time to then shut off or reduce such flow, as by operating valve 45 in line 13. A blow-off valve 48 relieves any excess pressure build-up in tank 41.

In FIG. 1, the diver is shown holding a tubular suction line 50 having a head 51 applicable to sand 52 or the like in a cold lake or stream for recovering gold particles, as on a sluice box. In this regard, the same engine 26 may be used to drive a pump 54 creating suction applied to line 50*a* as by aspiration at 55.

I claim:

1. In a system for supplying controlled temperature warm water to the space between a human body and a protector extending over the body, the combination comprising:

(a) a source of pressurized water, (b) a heat exchanger connected to said source to receive and heat the source water and discharge water at temperature $T_1$, (c) a mixing valve connected to the heat exchanger to receive the water discharge from the heat exchanger, the mixing valve having a cold water inlet and a discharge outlet and being operable to mix cold water with the water at temperature $T_1$ received from the heat exchanger, thereby to provide and discharge via said outlet a mixed water stream at controlled temperature $T_2$, where $T_2$ is less than $T_2$, (d) a separate buffer tank defining a plenum chamber connected with the mixing valve via said discharge outlet to receive discharged water at temperature $T_2$ for mixing with warm water in the plenum chamber, (e) a duct extending from an outlet positioned at the plenum chamber to deliver to said space water which consists of water in said plenum chamber mixed with water from said mixing valve, (f) and wherein said source comprises a pump, and including an internal combustion engine driving said pump, said engine having a hot exhaust gas outlet connected with said heat exchanger to heat water therein.

2. The system of claim 1 wherein said mixing valve has an associated thermostat for control of mixing so as to produce $T_2$ discharge water, and including a control valve in series with said duct whereby the user may operate said valve.

3. The system of claim 1 including said protector to which said duct extends.

4. The system of claim 3 wherein said protector comprises a wet suit.

5. The system of claim 1 including a dredge carrying said pump and engine.

6. The system of claim 1 wherein $T_2$ has a range of about 100° F. to 110° F., there being a conduit to conduct said 100° F. to 110° F. water to said plenum chamber.

7. The system of claim 3 including a control valve in said duct extending from the plenum chamber to said protector, to which the duct is connected.

8. The system of claim 1 including a second pump driven by said engine, and a gold particle recovery suction line to which the second pump is connected.

9. In a system for supplying controlled temperature warm water to the space between a human body and a protector extending over the body, the combination comprising:

(a) a source of cold water, and a source of hot water, (b) a mixing valve connected to said sources to receive cold water and hot water therefrom, the water in the mixing valve being pressurized, the mixing valve having a discharge outlet and operating to mix the cold and hot water and to discharge same via said outlet at desired temperature $T_2$, (c) a separate buffer tank defining a plenum chamber connected with the mixing valve via said discharge outlet to receive discharged water at temperature $T_2$ for mixing with warm water in the plenum chamber, (d) a duct extending from an outlet positioned at the plenum chamber to deliver to said space water which consists of water in said plenum chamber mixed with water from said mixing valve, (e) and a control valve in recess with said duct, near said space.

* * * * *